US006988516B2

(12) United States Patent
Debaes et al.

(10) Patent No.: US 6,988,516 B2
(45) Date of Patent: Jan. 24, 2006

(54) DEVICE FOR DRIVING AND GUIDING A RAPIER OF A WEAVING MACHINE

(75) Inventors: Johny Debaes, Moorslede (BE); Dominique Maes, Wakken (BE); Jo Hullebusch, Wevelgem (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 341 days.

(21) Appl. No.: 10/230,362

(22) Filed: Aug. 29, 2002

(65) Prior Publication Data

US 2003/0056849 A1 Mar. 27, 2003

(30) Foreign Application Priority Data

Aug. 29, 2001 (BE) ..... 2001-0563

(51) Int. Cl.
*D03D 47/04* (2006.01)

(52) U.S. Cl. ..... 139/441; 139/443; 139/444; 139/445; 139/446; 139/447; 139/448; 139/449

(58) Field of Classification Search ..... 139/443–449, 139/441
See application file for complete search history.

(56) References Cited

U.S. PATENT DOCUMENTS

| | | | | |
|---|---|---|---|---|
| 733,586 A | | 7/1903 | Hutchins | |
| 5,033,516 A | | 7/1991 | Debaes | |
| 5,538,049 A | * | 7/1996 | Homma et al. | 139/450 |
| 5,662,146 A | * | 9/1997 | Homma et al. | 139/97 |
| 5,727,601 A | * | 3/1998 | Krumm | 139/449 |
| 5,785,095 A | * | 7/1998 | Kinbara | 139/449 |
| 5,950,686 A | * | 9/1999 | Herrlein et al. | 139/449 |
| 6,161,597 A | * | 12/2000 | Meyns et al. | 139/449 |
| 6,167,918 B1 | * | 1/2001 | Moeneclaey | 139/448 |
| 6,230,759 B1 | * | 5/2001 | Shaw et al. | 139/449 |
| 6,276,403 B1 | * | 8/2001 | Shaw | 139/449 |
| 6,367,515 B1 | * | 4/2002 | Roelstraete | 139/449 |

FOREIGN PATENT DOCUMENTS

| | | |
|---|---|---|
| DE | 19534243 | 3/1997 |
| EP | 0312031 | 4/1989 |
| EP | 0482722 | 4/1992 |

* cited by examiner

*Primary Examiner*—John J. Calvert
*Assistant Examiner*—Robert H Muromot
(74) *Attorney, Agent, or Firm*—James Creighton Wray; Meera P. Narasimhan

(57) ABSTRACT

A device for driving and guiding a rapier of a weaving machine, comprises a rotatable drive wheel (1) provided for driving a rapier rod (14) in a back and forth movement and a guide channel formed by adjustable guide bodies (10), (11) in order to guide the said rapier rod (14) according to a guide path in co-operation with the drive wheel (1). The guide bodies (10), (11) are part of a guide unit (9) which, as a whole, is adjustable in order to modify the distance between the guide path and the rotation shaft (2) of the drive wheel (1), and where the drive wheel (1) is continuously adjustable in the longitudinal direction of its shaft (2). With this device the clearances of the rapier rod with respect to the drive wheel can be performed easily, rapidly and with great precision, so that this device is able to work with a minimum development of heat and wear.

20 Claims, 7 Drawing Sheets

DEVICE FOR DRIVING AND GUIDING A RAPIER OF A WEAVING MACHINE

This application claims the benefit of Belgian Application No. 2001/0563 filed Aug. 29, 2001.

BACKGROUND OF THE INVENTION

This invention relates to a device for driving and guiding a rapier of a weaving machine, comprising a rotatable drive wheel provided for driving a rapier rod in a back and forth movement, and a guide channel formed by adjustable guide bodies in order to guide the said rapier rod according to a guide path in co-operation with the drive wheel. This invention further relates to a rapier weaving machine provided with at least one such drive and guide device.

A rapier weaving machine is equipped with one or more rapier systems, each rapier system comprising two cooperating rapiers. Each rapier system is provided for inserting a weft yarn into a shed formed between the warp yarns each time in successive inserting cycles. In each inserting cycle, the rapiers situated on either side of the shed are first moved towards one another in this shed, while the one rapier takes along a weft yarn. The rapiers meet in the middle of the shed and there the weft yarn taken along is taken over by another rapier. Finally, both rapiers are withdrawn from the shed back into their original positions.

For a good operation of such a rapier system, the two cooperating rapiers have to meet in a respective position (hereafter called "the take-over position"), making an impeccable take-over of the weft yarn possible. Furthermore, the movement path of the rapiers must be situated at the right height, almost in the plane of symmetry of the shed. With narrow weaving machines, the movement path of the rapiers must run parallel to the reed. With wide weaving machines, the rapier heads must lean against the reed in order to obtain a safe take-over of the weft yarn. For these reasons the known drive and guide devices for rapiers are provided with means, with which the movement paths of the rapier can be exactly adjusted.

Known rapiers primarily consist of a rapier rod with a built-in gear-rack, which carries a rapier head at its extremity that is provided with gripping means to take along a weft yarn. The rapier drive occurs by means of a drive gearwheel that acts on a gear-rack and is rotated in the one and the other sense of rotation alternatively in order to move the rapier into or out of the shed. In order to keep the rapier rod within reach of the drive gearwheel during this drive and to avoid lateral movements of the rapier rod, this rapier rod is guided in a U-shaped guide channel.

In the Belgian patent n° 1 000 994 a drive and guide device for such a rapier is described, having a molded guide channel for the rapier rod, in which a series of guide rollers is provided opposite the drive gearwheel. The guide channel is connected, in a manner adjustable as to height, to the casing of the drive gearwheel, and this casing itself is likewise rotatable in order to be able to give the guide channel the exact orientation. These adjustments allow the take-over position of the rapier head to be adjusted in order to obtain an efficient take-over of the weft yarn. The guide rollers are mounted in a frame that is adjustable in a direction at right angles at the paths of movement in order to guide the rapier rods at the exact distance of the drive gearwheel. This device has the disadvantage that particularly much heat is developed, and that the rapier rods, especially at relatively high weaving speeds, are subject to premature wear.

In the Belgian patent n° 1 004 622 such a drive and guide device is described, the U-shaped guide channel of which is formed between a profile with an L-shaped cross-section on the one side, and a guide ruler, hingedly attached and which can be moved back in order to open the guide channel at the front, on the other side. The guide ruler comprises only one guide roller near the point where the drive gearwheel acts on the gear-rack to absorb the radial force exerted by the gearwheel on the rapier rod. The guide ruler with the guide roller is adjustable in a horizontal direction at right angles on the direction of the path of movement. The L-section is supported by a carrier arm, which is adjustable in a horizontal direction.

In order to limit wear and development of heat to a minimum, it is important that the gear-rack is guided at the correct distance from the gearwheel. On the other hand, the rapier rod also is to be guided at the correct height, so that the gearwheel might act in the middle of the tooth space of the gear-rack. This to avoid that the teeth should rub against the sidewalls of the tooth spaces of the gear-rack. If both clearances (the horizontal and the vertical clearances) are not adjusted correctly, this might provoke premature wear of the gear-rack and an exaggerated heating of the rapier envelope, which will cause its rapid decline.

To adjust the horizontal clearance of the device according to the Belgian patent n° 1 004 622 first the carrier arm to which the L-section is attached must be moved in the horizontal direction, and thereafter the hinged guide ruler with the guide roller must be adjusted again into the correct position in order to obtain a guide channel having the exact width. In order to be able to adjust the vertical clearance the L-sections can be adjusted as to height, but the hinged guide ruler must be adjusted separately on the side of the guide roller by inserting or removing thin shims between the hinge and the guide slat. The installation level of the drive gearwheels can also be adjusted step by step by means of shims. These adjustments of the vertical and horizontal clearances are difficult to perform and cannot be carried out with the required precision and moreover, they are particularly time-consuming and complicated.

SUMMARY OF THE INVENTION

The purpose of the present invention is to provide for a drive and guide device for a weaving machine rapier, allowing an easier and more precise adjustment of the clearances between gearwheel and gear-rack, and the working of which, because of an improved adjustment of these clearances, will cause less wear and development of heat.

The purpose mentioned above is attained by a drive and guide device for a rapier of a weaving machine, comprising a rotatable drive wheel, provided in order to give a back and forth movement to a rapier rod and a guide channel formed by adjustable guide bodies in order to guide the said rapier rod along a guide path in co-operation with the drive wheel, the guide bodies, according to this invention, being a part of a guide unit, which, as a whole, is adjustable in order to modify the distance between the guide path and the axis of rotation of the drive wheel, and the drive wheel which is continuously adjustable along the longitudinal direction of its axis.

With this device, the distance between the drive wheel and the rapier rod can be adjusted in a direction at right angles to the plane of the axis by simply sliding the guide unit. A continuous adjustment of the drive wheel in the direction of the drive shaft makes it possible to mutually modify and adjust the installation of drive wheel and rapier rod, also in the direction of the axis. Both adjustments can be performed very easily and with great precision, so that the said clearances may be adjusted with optimum precision in order to obtain a drive and guide device reducing wear and development of heat to a minimum.

Preferably, the drive wheel is attached to its shaft in a continuously adjustable manner by means of an internal bicone shaft hub connection.

In a preferred embodiment, the device according to this invention is carried out in such a manner that the said guide unit is slidable over a supporting surface in order to adjust the said distance. Because of this construction of the guide unit, there is no need for a supplementary support after the fastening or fixing means have been loosened and adjustment may occur in a particularly precise manner, for instance, by means of an adjusting spindle screw.

Preferably, the drive wheel is provided on the shaft in a slidable manner, while an internal bicone shaft hub connection for fixing it in the desired position is provided.

Preferably the device is carried out with a guide unit comprising also guide means to absorb the forces exerted by the drive wheel on the rapier rod in the guide channel. Because the guide means are part of the adjustable guide unit, the position of the guide means, with respect to the guide path, is maintained when adjusting the guide unit.

Preferably, the said guide means comprise a rectilinear air bearing. Such an air bearing is capable of absorbing strong radial forces, so that development of heat is considerably reduced in consequence of which the life of the rapier rods and of the guide bodies is considerably increased. Moreover, the development of heat in the air bearing can be monitored by means of a temperature sensor, so that the weaving machine can be put out of action in case of too sharp a rise in temperature. This may happen, for instance, in consequence of a breakdown of the compressed air supply or of the air inlet holes of the bearing getting clogged. In this way, damage to the rapier rods can be avoided.

Preferably, the said guide means, and particularly the air bearing mentioned above, are installed in such a manner that they determine a guide surface situated in the same plane as a guide surface of the guide channel. Because of this, the rapier rod remains straight under the highest radial or lateral loads.

In a particularly preferred embodiment, the device is provided with a guide unit comprising a guide slat, which can be brought into an operative position in which the guide channel is limited on one side and is movable into another position in order to make the guide channel accessible on the said side. In such an embodiment, a rapier rod can be removed from the guide channel very easily.

Preferably, the guide slat is hingedly attached to a fixed part of the guide unit. In addition to that, the guide channel may be constituted by the said guide slat on the one side and an elongated molded piece having an L-shaped cross-section, while the guide slat is attached to the molded piece in a hinged manner.

In an advantageous embodiment, the said guide means, and more particularly the air bearing, are attached to the guide slat, while the guide slat is adjustable in order to modify the width of the guide channel. Because the guide slat and the guide means are adjustable together, now the adjustment of the width of the guide channel can be carried out very easily and rapidly. It may, for instance, be necessary to adapt the width of the guide channel to a rapier rod having deviating transverse dimensions.

In a preferred drive and guide device, the guide unit is attached to a casing or part of a casing for one or several drive wheels. Several guide units can be adjustably attached to a respective segment of a casing and these segments can be placed above one another in such a manner that they form the complete casing for a number of drive wheels, provided above one another, while the guide units are provided for guiding rapier rods, co-operating with these drive wheels. When the word casing is used in this patent application, then both a complete casing and a component part of a casing are meant.

Preferably, each guide unit is also rotatable as a whole in order to adjust the direction of the guide path. This will permit an exact adjustment of the guide path in order to obtain an ideal take-over position of the rapier head.

When the guide unit is attached to a casing for the drive wheel and said casing is rotatable with respect to the axis of the drive wheel, the take-over position of the rapier head can be adjusted, while the adjustments of the clearances between the rapier rod and the drive wheel remain unchanged.

In a preferred embodiment, the casing for the drive wheel can be fixed in an adjusted position by means of fixing means, in which case fixing and loosening these fixing means may be carried out near a top of said casing. Because the fixing means are well accessible, adjusting the direction of the guide path can be carried out easily and rapidly.

Preferably, the device comprises a casing for the drive wheel and a bearing housing in which the bearings of the shaft of the drive wheel are lodged, the guide unit being attached to the casing of the drive wheel and the casing for the drive wheel being attached to a fixed part of the device, so that the bearing housing is detachable while the settings of the guide unit are maintained. This means a considerable timesaving in case of inspection or replacement of the bearing or of any other piece of this part incorporated in the bearing housing, such as, for instance, a bevel gear on the drive shaft.

In a most preferred embodiment the guide unit is attached to a casing for the drive wheel by means of a fastening means with two legs, which legs are adjustably attached to this casing, on both sides of the casing and resting on supporting surfaces respectively, molded on this casing, the distance between the guide path and the axis of the drive wheel being adjustable, because said legs may be shifted over their respective supporting surfaces and may be fixed in a position as desired.

The device may also be carried out having at least two guide units installed above one another, each guide unit being attached to a respective part of a casing for one or several drive wheels, thus this device can be carried out to drive and guide the rapiers of a double rapier weaving machine, or of a weaving machine with three or more rapier systems working above one another. Moreover, each guide unit can be installed individually without the adjustment of the one guide unit being influenced by the other unit.

Moreover, each guide unit can also be adjustable as a whole, in a direction running practically parallel to the axis of the drive wheel. This is possible, for instance, by means of shims and may be necessary, among other things, to adapt the differences in height between the guide units provided one above the other to the desired pile height.

Preferably, the guide unit also comprises an extensible rod, which carries a supporting means for a rapier head. When the height or the orientation of the guide channel or its distance with respect to the drive shaft is modified, the position of the supporting means is likewise adapted in a suitable manner.

A very suitable embodiment is carried out in such a manner that the guide path is practically horizontal, that each guide unit is movable, as a whole, in a horizontal plane in order to adjust the distance between the guide path and the axis of the drive wheel, is rotatable in a horizontal plane in order to adjust the direction of the guide path and is adjustable as to height in order to adjust the height of the guide path.

This invention further relates also to a rapier weaving machine comprising at least one rapier moving back and forth having a drive and guide device carried out in accordance with this invention.

These and other characteristics and particulars of the device according to the present invention will be clarified and illustrated in the following detailed description of one of its possible embodiments.

It may be clear that the only purpose of this description is to clarify the invention by means of an example and therefore in no way may be considered as a limitation of the scope of this patent protection.

In this description reference is made, by means of reference numbers, to the attached drawings of which:

DETAILED DESCRIPTION OF THE PREFERRED EMBODIMENTS

Figure 1:
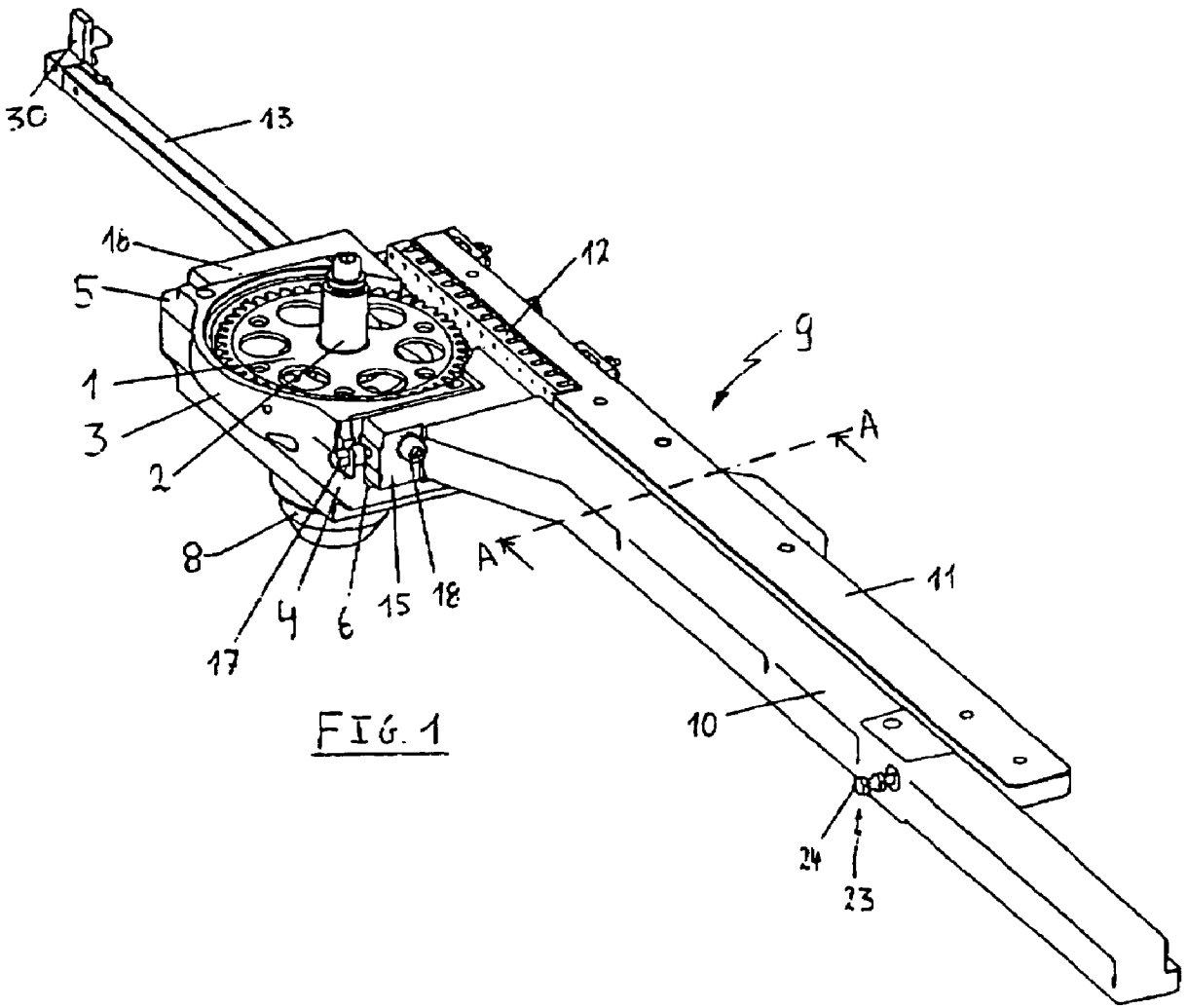
FIGS. 1 and 2 are perspective representations of a device for driving and guiding a rapier according to the present invention.
Figure 2:
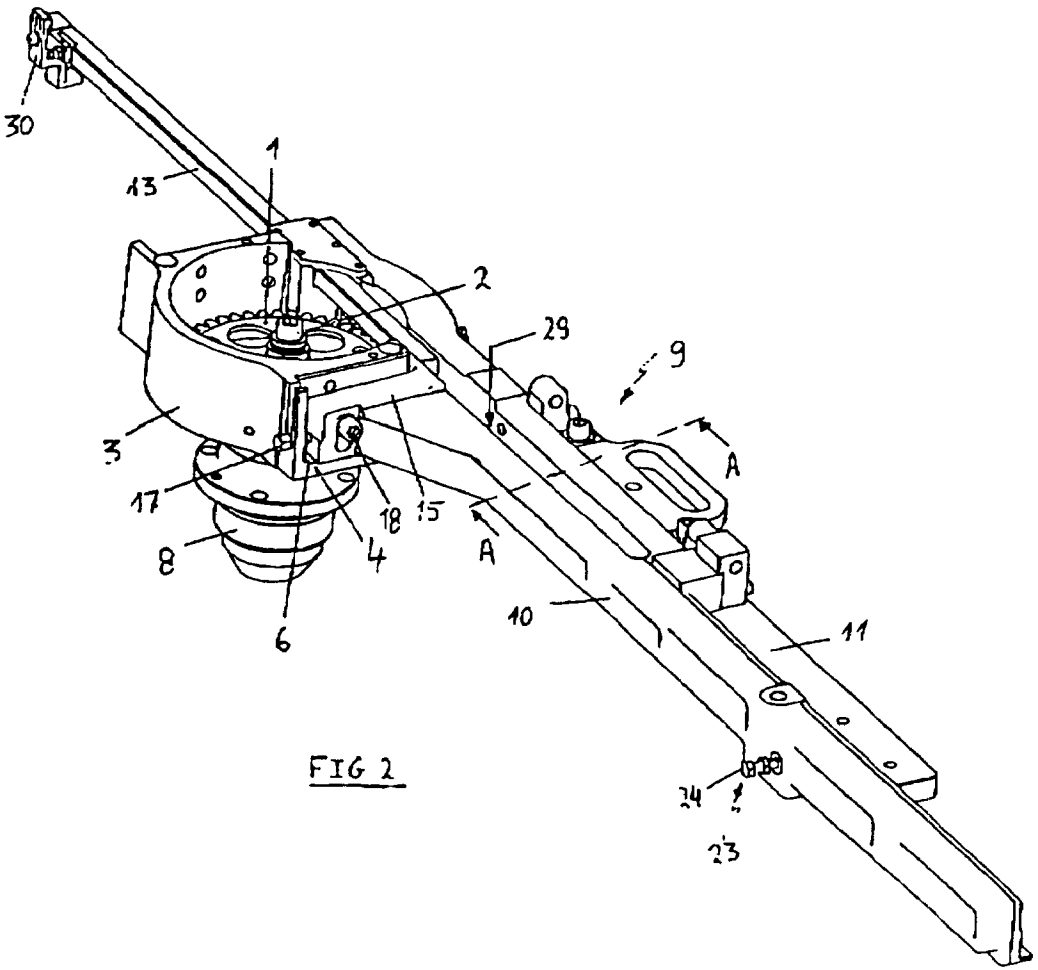

The drive and guide device represented in the FIGS. 1 and 2 comprises a drive wheel (1) mounted on a drive shaft (2) extending vertically and incorporated in a casing (3), hereafter called "the drive casing (3)". The drive casing (3) has laterally projecting collars (4),(5) on two opposite flanks, the tops of which constitute a horizontal supporting surface (6), (7) for the legs (15), (16) of the fastening fork to be further described. Under the drive casing (3) a second housing (8) has been provided, (hereafter called "the bearing housing (8)" in which the bearings of the drive shaft have been incorporated.

Figure 3:
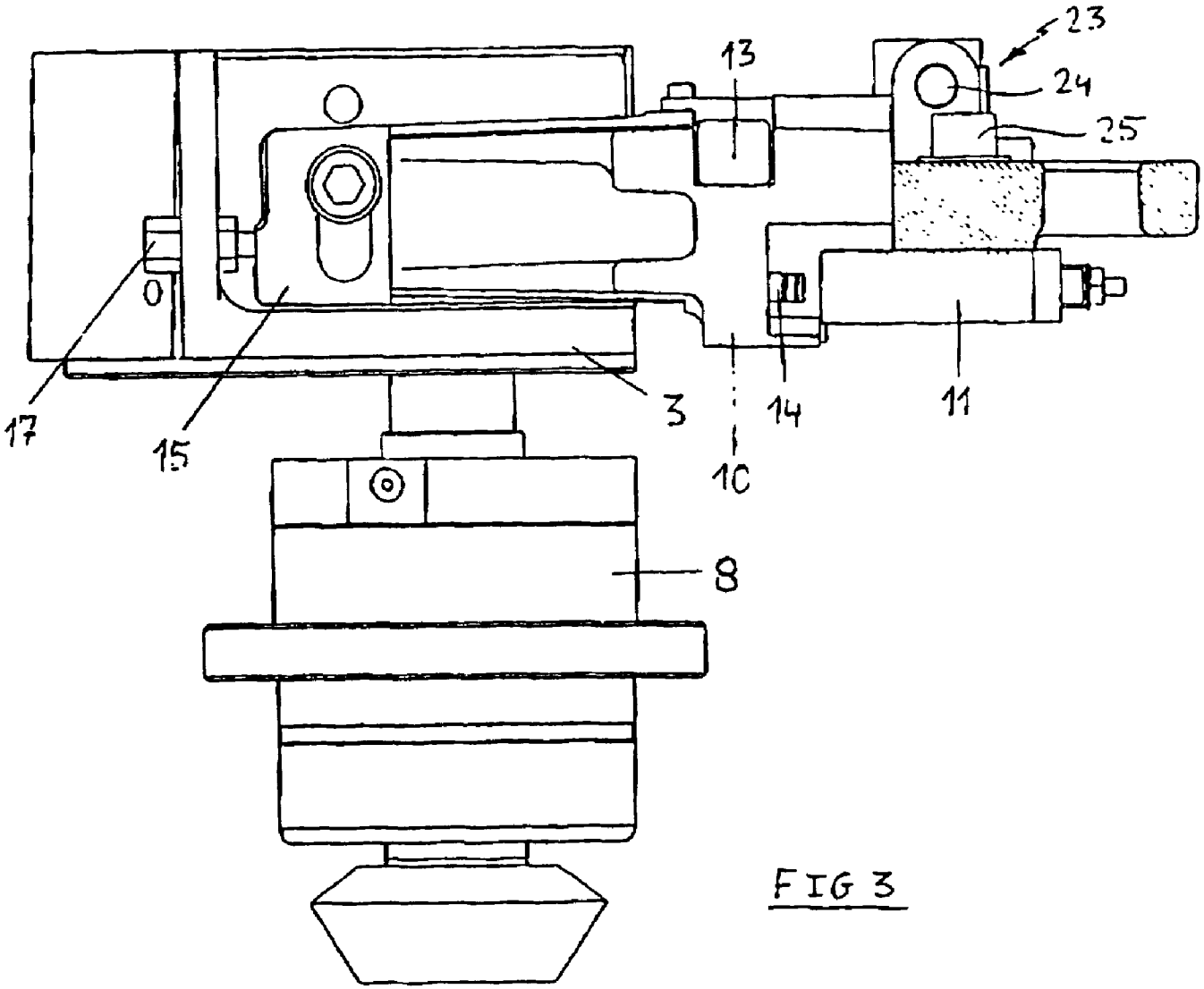
FIG. 3 is a vertical cross-section of the device represented in the FIGS. 1 and 2, according to the axis A—A indicated in these figures.
Figure 4:
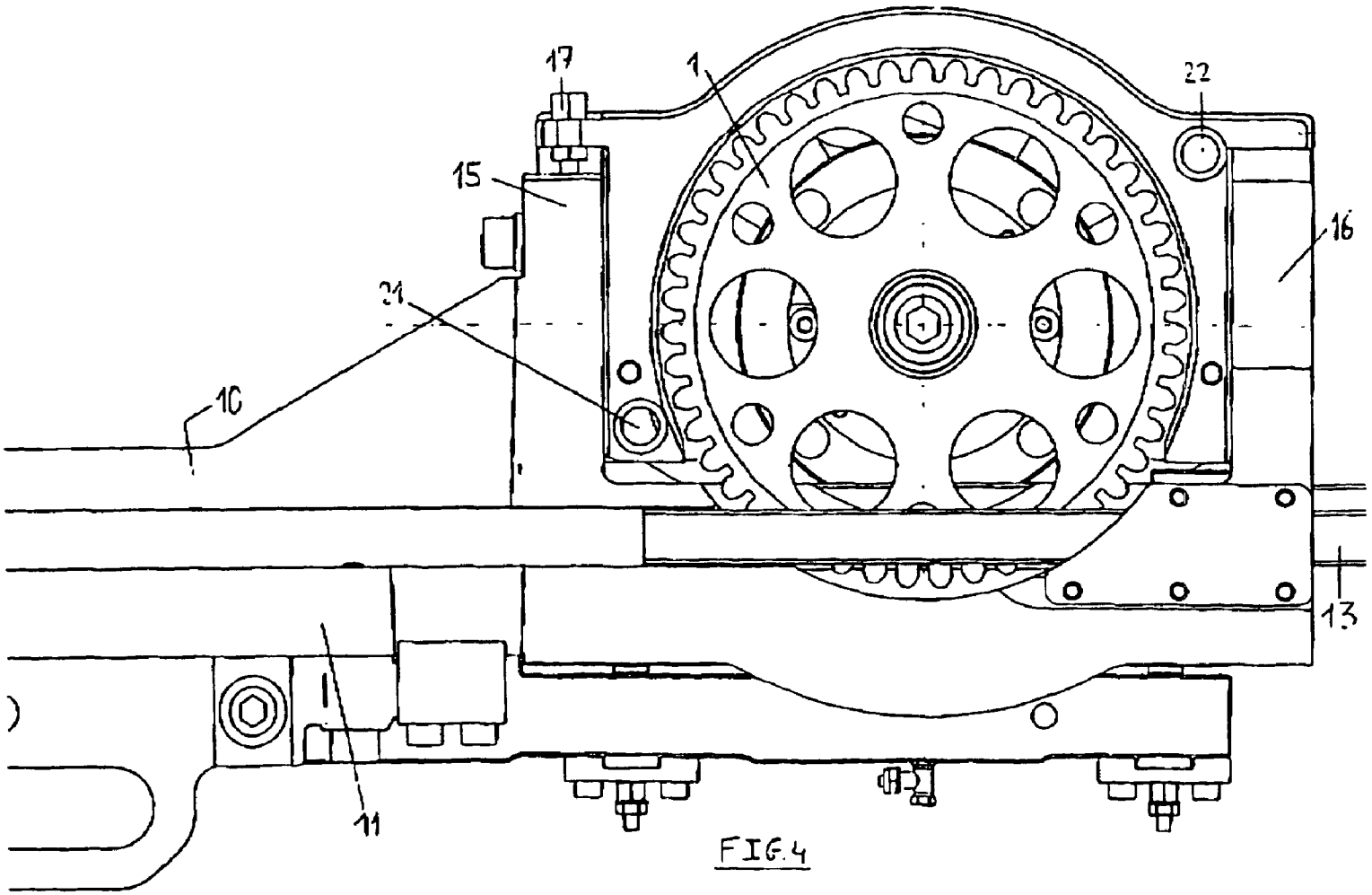
FIG. 4 is a top view at the level of the drive wheel of the device represented in the FIGS. 1 and 2.

A guide unit (9) is attached to the drive casing (3). It consists of an elongated molded supporting part (10) having an L-shaped cross-section (hereafter called "the L-section (10)", a guide ruler (11) with built-in air bearing (12) hingedly connected to this L-section (10) and an extensible rod (13), forming a whole together. Between the L-section (10) and the guide ruler (11) a U-shaped guide channel for a rapier rod is formed. A cross-section of the channel for such a rapier rod (14) is only represented in FIG. 3. The rod (13) is slidable in a separate channel (29) and carries a support (30) at its extremity to support a rapier head and to guide the rapier rod.

The guide unit (9) is attached to the drive casing (3) in such a manner that the distance between the centerline of the drive shaft (2) and the U-shaped guide channel is adjustable. To that effect, the L-shaped section (10) is provided with an fastening fork having two parallel legs (15),(16) extending at right angles to the longitudinal direction of the L-section on both sides of the drive casing (3) and are resting on the horizontal supporting surfaces (6),(7) of the collars (4),(5) mentioned above. In order to adjust the distance between the centerline of the drive shaft (2) and the guide channel, the legs (15), (16) may be slid over the said supporting surfaces (6),(7).

The L-shaped section (10) extends over the full length of the rapier rod when this rod has been withdrawn completely from the shed. The L-section (10) is preferably made of one piece, has an L-shaped section at one side and the opposite side is provided with the fastening fork mentioned above having two cross-directed legs (15), (16). These legs are made integral with the L-section. Shifting of the said legs (15),(16) over their respective supporting surfaces (6),(7) is done by an adjusting spindle screw (17) acting on one of the legs (15),(16). Finally, to fix the fastening fork, use is made of a bolt connection (18). Shifting occurs in the warp direction. During this shifting, the guide unit (9) is maintained in a horizontal position, because the legs (15),(16) are resting on the said horizontal supporting surfaces (6), (7) of the collars (4), (5) forming integral parts of the drive casing (3). In this manner, adjusting can be performed with great precision.

In order to absorb the radial forces exerted on the rapier rod (14) by the drive gearwheel (1) and to prevent the development of heat, a rectilinear fixed air bearing (12) of sufficient length is built into the extendible guide ruler (11) in the place of the zone of action between the drive gearwheel (1) and the gear-rack of the rapier rod. This bearing (12) is capable of absorbing strong radial forces developing much less heat. Because of which the life of the rapier rod is considerably prolonged.

The guide surface of the air bearing (12), i.e. the surface in which the holes of the air blowers are situated and the guide surface of the hinged guide ruler (11) are situated in a same plane, so that the rapier rod in rest as well as in motion has a perfectly smooth guide surface. Because of this, the rapier rod is maintained in a perfectly upright position, even when under the influence of the heaviest radial and lateral loads in consequence of the action of the drive gearwheel (1). The rapier rods (14) are guided better and the take-over is strongly improved at high weaving speeds. This is confirmed by a reduced number of stops of the weaving machine due to loss of weft yarn at or after the central take-over of the weft yarn.

The development of heat in the air bearing (12) is monitored by a temperature sensor (not represented in the drawings). In case the temperature should become too high because of a breakdown of the compressed air supply or of the air blowing holes being obstructed, the weaving machine is put out of action for an inspection, because of which any damage to the rapier rods is avoided.

The rapier drive gearwheel (1) is continuously adjustable as to height by shifting it on its drive shaft (2) and this adjusting height is adapted to the height of the rapier rod lying on the L-section (10), consequently the action takes place in the middle of the gear-rack. The rapier drive gearwheel is fixed in the desired position by means of an internal bicone shaft hub connection (19).

Furthermore, the drive casing (3) can be rotated with respect to the drive shaft (2) and be adjusted in an orientation as desired. At the bottom the drive casing (3) is centered around a collar (20) of the bearing housing (8) and is fixed by two vertical bolts (21), (22), the heads of which reach up to the top surface of the drive casing (3). At the top, these bolts (21),(22) are easily accessible. In order to adjust the direction of the rapiers in a precise manner, a second adjustable fixing point (23) to attach the L-section (10) to the frame of the weaving machine is provided on the other side, away from the rapier drive casing. Here also an adjusting spindle screw has been provided for adjusting purposes.

In order to be able to free the drive shaft (2) without removing the guide unit (9) the drive casing (3) is centered on the collar (20) of the bearing housing (8) but this is realized in such a manner that the bearing housing (8) can be removed without being obliged to remove the guide unit (9). The drive casing (3) remains firmly fixed to the frame of the device by means of the bolts (21),(22). During this operation, the settings of the guide unit (9) can be maintained completely. This means a considerable saving of time during inspections or when replacing the bearings of the bevel gear on the drive shaft (2).

The guide ruler (11) is hingedly attached to the L-section (10). The guide ruler (11) is attached to the hinges by means of bolts (25) in order to be able to adjust the clearance of the rapier rod in the U-shaped guide channel and therefore to be able to adapt the width of the channel to the varying dimensions of the cross-sections of the rapier rods sections. Because the guide ruler (11) and the air bearing (12) are in one piece, this adaptation can be performed easily and rapidly.

Figure 6:
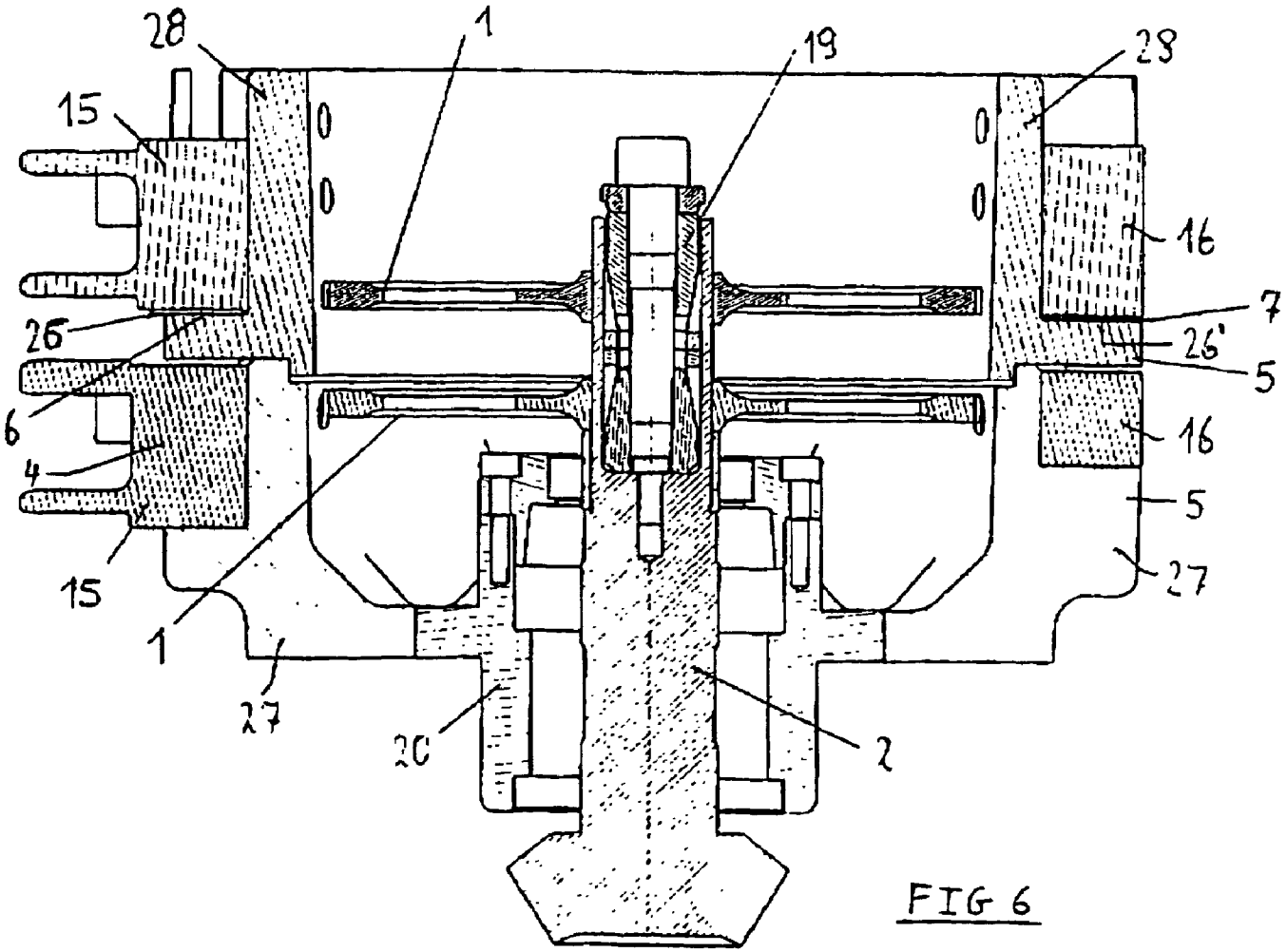
FIG. 6 is a vertical cross-section according to the plane of the drive shaft of the two devices represented in FIG. 5.

The height of the U-shaped guide channel is adjustable in a step by step manner by means of shims (25), (26), which can be placed or not on the supporting surfaces (6), (7) of the drive casing (3) and under the protruding legs (15, 16) of the guide unit (9) (as represented in FIG. 6). The exact distance of the drive gearwheel (1) is adjusted continuously with respect to the center of the gear-rack of the rapier rod by moving the drive gearwheel (1) on its shaft (2), the gearwheel (1) being fixed in the desired position by means of an internal bicone shaft hub connection (19).

Figure 5:
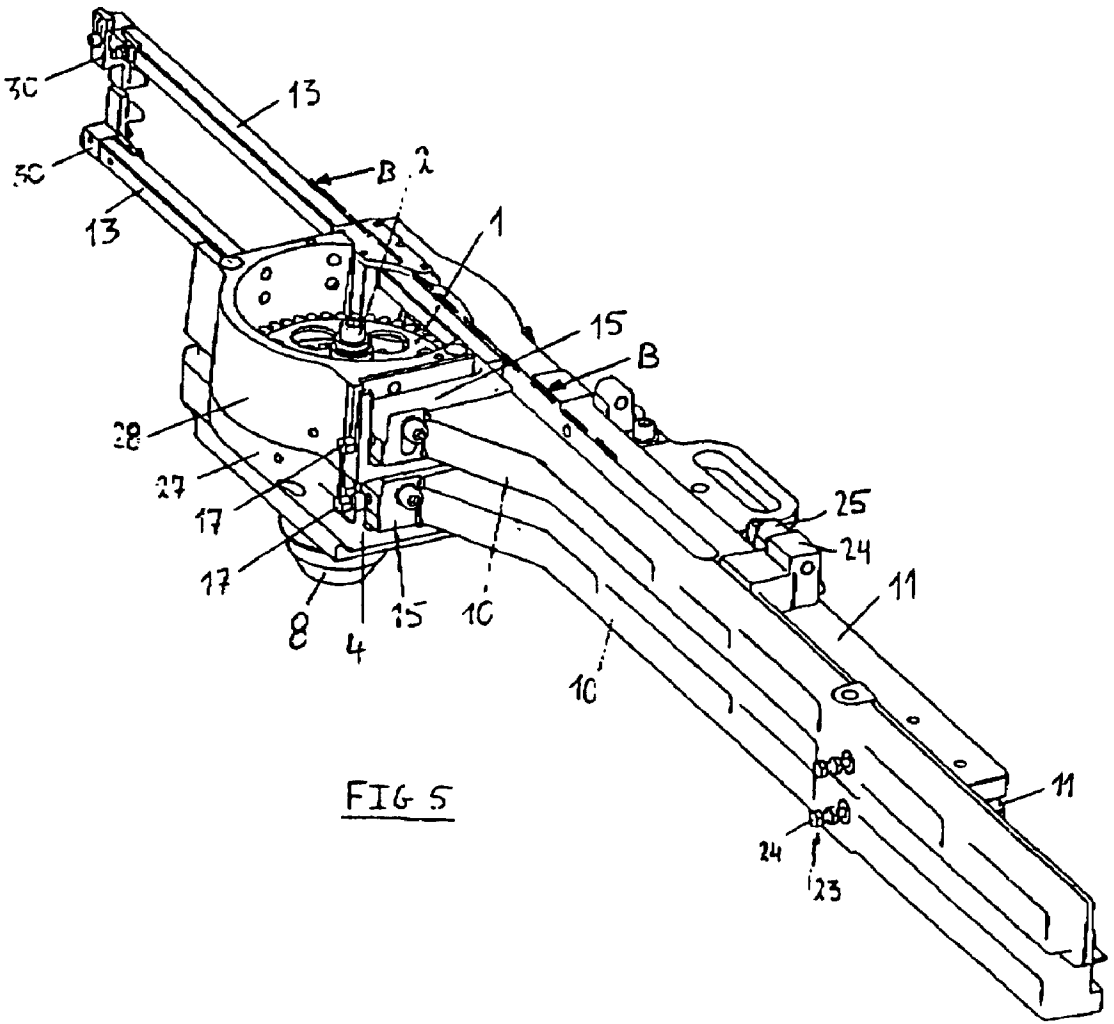
FIG. 5 represents two such drive and guide devices, provided above one another for driving and guiding rapiers working one above the other of a double rapier weaving machine.
Figure 7:
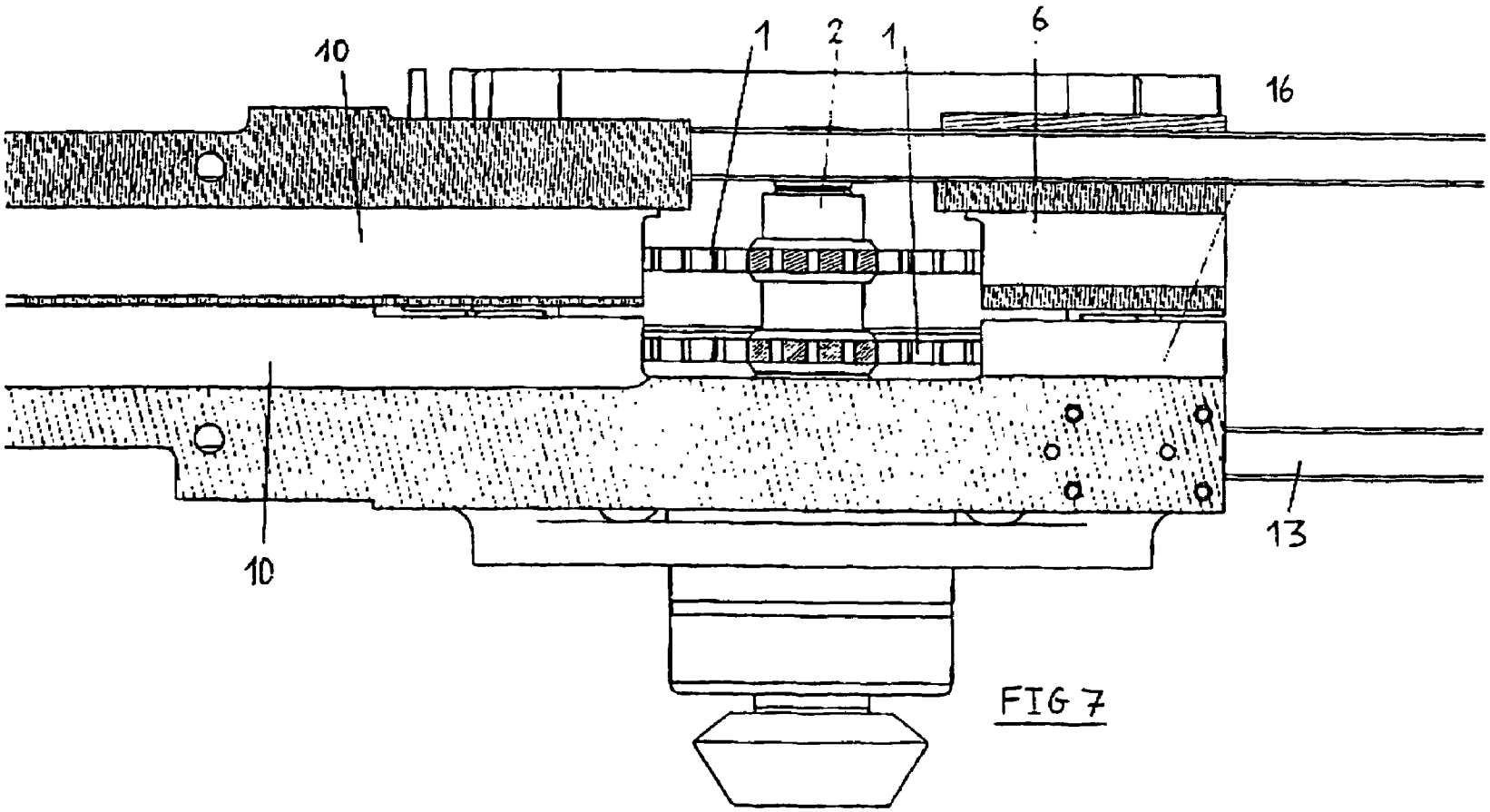
FIG. 7 is a vertical cross-section of a part of the device represented in FIG. 5 according to the axis B—B indicated in this figure.

The building up of a drive and guide device for a double rapier weaving machine or for a weaving machine having three or more rapiers (see FIGS. 5, 6 and 7) is done by positioning drive casing segments (27),(28) in layers above one another, to which each time a guide unit (9) of the above-mentioned construction is attached. Each drive and guide device should be installed at the level at which a shed is formed. When weaving face-to-face pile fabrics the difference in height between the sheds formed above one another depends on the pile height to be woven. This adjustment in height is done in continuously by putting one or several shims (26),(26') having a certain thickness between the respective drive casing segments (27). Adjusting the direction or orientation of the rapier rods (14)—in a horizontal plane—is done with the help of bolts (21), (22), passing all through these drive casing segments (27),(28), and the heads of which are well accessible at the top for loosening and fastening the connection. The drive casing segments (27),(28) are centered in the drive casing (3) or with respect to each other by means of a projecting collar. These segments (27),(28) each have their own collar (4),(5), forming supporting surfaces (6),(7) for the legs (15),(16) of an L-section (10) and an adjusting screw spindle (17) for adjusting the distance between the shaft of the gearwheel (2) and the guide channel. In this manner, each guide channel can be adjusted separately.

The two drive gearwheels (2) provided above one another are continuously adjusted as to height on a common drive shaft (2) in order to adapt their in-between distance. This is done by an adjustable displacement on the vertical drive shaft (2). The drive gearwheels (2) can be placed perfectly in the center of the gear-rack of the rapier rod and be fixed on the common shaft (2) by means of a screw via an internally placed bicone shaft hub connection (19).

Each drive casing (3) or each drive casing segment (27),(28) is provided with a channel (29), either at the top or at the bottom, in which an extensible rod may be attached. At its free extremity, the rod (13) carries a support or guide table (30) for the rapier heads. By moving these rods (13) in or out, these supports (30) are placed exactly where they are needed in accordance with the width of the fabric to be woven. Each rod (13) is attached to a respective guide unit (9), so that a modification of the distance between guide channel and drive shaft (2) or of the direction of the movement path of the rapier on a certain guide unit will immediately result in a corresponding adjustment of the supports (30) of the rapier heads concerned.

On the drive and guide device according to the invention therefore, each guide unit can be adjusted individually without adjusting the one having any influence on another guide unit. Adjustments can be made with great precision and are far less time-consuming. Moreover, the rapier bearing will develop far less heat, even at higher weaving speeds. By means of a temperature sensor the device can be monitored very easily.

What is claimed is:

1. Device for driving and guiding a rapier of a weaving machine, comprising a rotatable drive wheel provided to drive a rapier rod in a back and forth movement and a guiding channel formed by adjustable guiding bodies in order to guide the said rapier rod according to a guide path in cooperation with the drive wheel, wherein the guide bodies are part of a guide unit, which, as a whole, is adjustable in order to modify the distance between the guide path and the rotation shaft of the drive wheel, and in that the drive wheel is steplessly adjustable in the longitudinal direction of its shaft.

2. Device for driving and guiding a rapier of a weaving machine according to claim 1, wherein the said guide unit is slidable over a supporting surface in order to adjust the said distance.

3. Device for driving and guiding a rapier of a weaving machine according to claim 1, wherein the said guide unit comprises guide means in order to absorb the forces exerted on the rapier rod by the drive wheel in the guide channel.

4. Device for driving and guiding a rapier of a weaving machine according to claim 2, wherein the said guide means comprise a rectilinear air bearing.

5. Device for driving and guiding a rapier of a weaving machine according to claim 1, wherein the said guide means determine a guide surface situated in the same plane as the guide surface of the guide channel.

6. Device for driving and guiding a rapier of a weaving machine according to claim 1, wherein the guide unit comprises a guide slat, which can be brought into an active position, where this slat confines one side of the guide channel, and which is movable to another position in order to render accessible the guide channel on the other side.

7. Device for driving and guiding a rapier of a weaving machine according to claim 6, wherein the guide channel is formed by the said guide slat on the one hand and by an elongated molded piece having an L-shaped section, and in that the guide slat is hingedly attached to the molded piece.

8. Device for driving and guiding a rapier of a weaving machine according to claim 7, wherein the said guide means are attached to the guide slat and in that the guide slat is adjustable in order to adjust the width of the guide channel.

9. Device for driving and guiding a rapier of a weaving machine according to claim 1, wherein the guide unit is attached to a casing or to a part of a casing for one or several drive wheels.

10. Device for driving and guiding a rapier of a weaving machine according to claim 1, wherein the guide unit, as a whole, is rotatable in order to adjust the direction of the guide path.

11. Device for driving and guiding a rapier of a weaving machine according to claim 10, wherein the guide unit is attached to a casing for a drive wheel, and in that the said casing is rotatable with respect to the shaft of the drive wheel.

12. Device for driving and guiding a rapier of a weaving machine according to claim 11, wherein the casing for the drive wheel is fixable in an adjusted position by means of fixing means, and in that fixing and loosening these fixing means at the level of a top surface of the said casing can be performed.

13. Device for driving and guiding a rapier of a weaving machine according to claim 1, wherein the device comprises a casing for the drive wheel and a bearing housing in which the bearings of the shaft of the drive wheel are incorporated, in that the guide unit is attached to the casing for the drive wheel and in that the casing for the drive wheel is attached to a fixed part of the device, so that the bearing housing is removable whilst the setting of the guide unit is maintained.

14. Device for driving and guiding a rapier of a weaving machine according to claim 1, wherein the guide unit is attached to a casing for a drive wheel by means of a fastening means having two legs which, on both sides of the casing and resting on respective supporting surfaces molded to this casing, are connected to this casing in an adjustable manner, and in that the distance between the guide path and the shaft of the drive wheel is adjustable because the said legs may be shifted over their respective supporting surfaces and may be fixed in a position as desired.

15. Device for driving and guiding a rapier of a weaving machine according to claim 1, wherein this device comprises at least two guide units installed above one another and in that each guide unit is attached to a respective part of a casing for one or several drive wheels.

16. Device for driving and guiding a rapier of a weaving machine according to claim 1, wherein each guide unit, as a whole, is adjustable in a direction running practically parallel to the shaft of the drive wheel.

17. Device for driving and guiding a rapier of a weaving machine according to claim 1, wherein the guide unit comprises an extensible rod, that carries a supporting means for a rapier head.

18. Device for driving and guiding a rapier of a weaving machine according to claim 1, wherein each guide unit, as a whole, is movable in a horizontal plane in order to adjust the distance between the guide path and the shaft of the drive wheel, is rotatable in a horizontal plane in order to adjust the direction of the guide path and is adjustable in height in order to adjust the height of the guide path.

19. Device for driving and guiding a rapier of a weaving machine according to claim 1, wherein the drive wheel is attached to the shaft in a continuously adjustable manner by means of an internal bicone shaft hub connection.

20. Rapier weaving machine comprising at least one rapier, movable back and forth, having a drive and guide device, wherein the drive and guide device is carried out according to claim 1.

* * * * *